US011813206B2

(12) United States Patent
Myers

(10) Patent No.: US 11,813,206 B2
(45) Date of Patent: Nov. 14, 2023

(54) POSITIONING DEVICE AND METHOD OF USE THEREOF

(71) Applicants: Rush University Medical Center, Chicago, IL (US); Jonathan A. Myers, Chicago, IL (US)

(72) Inventor: Jonathan A. Myers, Chicago, IL (US)

(73) Assignee: RUSH UNIVERSITY MEDICAL CENTER, Chicago, IL (US)

( * ) Notice: Subject to any disclaimer, the term of this patent is extended or adjusted under 35 U.S.C. 154(b) by 23 days.

(21) Appl. No.: 15/733,919

(22) PCT Filed: Jun. 4, 2019

(86) PCT No.: PCT/US2019/035357
§ 371 (c)(1),
(2) Date: Dec. 1, 2020

(87) PCT Pub. No.: WO2019/236555
PCT Pub. Date: Dec. 12, 2019

(65) Prior Publication Data

US 2021/0220204 A1 Jul. 22, 2021

Related U.S. Application Data

(60) Provisional application No. 62/680,732, filed on Jun. 5, 2018.

(51) Int. Cl.
*A61G 13/12* (2006.01)

(52) U.S. Cl.
CPC ..... *A61G 13/1235* (2013.01)

(58) Field of Classification Search
CPC ..... A61G 13/1235
See application file for complete search history.

(56) References Cited

U.S. PATENT DOCUMENTS

| | | | | |
|---|---|---|---|---|
| 2,605,152 | A | 7/1952 | Krewson | |
| 5,211,186 | A | 5/1993 | Shoemaker et al. | |
| 6,295,987 | B1 * | 10/2001 | Parker | A47C 16/025 108/116 |
| 2005/0022825 | A1 | 2/2005 | Larson et al. | |
| 2010/0018537 | A1 | 1/2010 | Soto et al. | |
| 2015/0190297 | A1 | 7/2015 | Rajagopal | |

FOREIGN PATENT DOCUMENTS

| | | | | |
|---|---|---|---|---|
| EP | 0481761 A2 * | 4/1992 | | A61N 2/02 |

OTHER PUBLICATIONS

International Search Report, issued in PCT/US2019/035357, dated Aug. 8, 2019.
International Preliminary Report on Patentability, issued in PCT/US2019/035357, dated Dec. 8, 2020.

* cited by examiner

*Primary Examiner* — Robert G Santos
*Assistant Examiner* — Adam C Ortiz
(74) *Attorney, Agent, or Firm* — Barnes & Thornburg LLp

(57) ABSTRACT

The present invention generally relates to a positioning device for positioning the limbs of a patient placed on an operating room table and to methods of using such a device. In one embodiment, the device provides for the positioning of the arms of a patient positioned supine on an operating room table.

11 Claims, 3 Drawing Sheets

POSITIONING DEVICE AND METHOD OF USE THEREOF

RELATED APPLICATION

This application is a National Stage application of International Application No. PCT/US2019/035357, filed on Jun. 4, 2019, which claims priority to U.S. Provisional Application No. 62/680,732, filed with the United States Patent and Trademark Office on Jun. 5, 2018, both of which are incorporated by reference in their entirety.

TECHNICAL FIELD

The present invention generally relates to a positioning device for positioning the limbs of a patient placed on an operating room table and to methods of using such a device. In one embodiment, the device provides for positioning the arms of a patient lying supine on an operating room table.

BACKGROUND

Anterior Lumbar Interbody Fusion (ALIF) is a spine surgery that approaches the spine from an anterior approach with the patient lying supine on the operating room table. Fluoroscopy via a mobile C-arm X-ray system is utilized during the procedure. In order to facilitate the movement of the c-arm system along the length of the operating room table, the patient's arms are frequently secured in a crossed fashion across the chest. This may be performed in an imprecise fashion with padding and tape, which is time consuming, limits intraoperative access to the upper extremities, and may be unstable.

SUMMARY

One aspect of the present invention provides a positioning device including a cross-member having a top edge, a bottom edge, a first side edge and a second side edge. A first side member attaches at the first side edge and extends away from a first face of the cross member. A second side member attaches at the second side edge and also extends away from the first face of the cross member.

In one embodiment, the device includes a first leg attaching to the first side edge and extending downwards beyond the bottom edge and a second leg attaching to the second side edge and extending downwards beyond the bottom edge. The cross member, the first side member and the second side member define a cavity sized to accommodate a patient's arms.

DETAILED DESCRIPTION

Definitions

Figure 1:
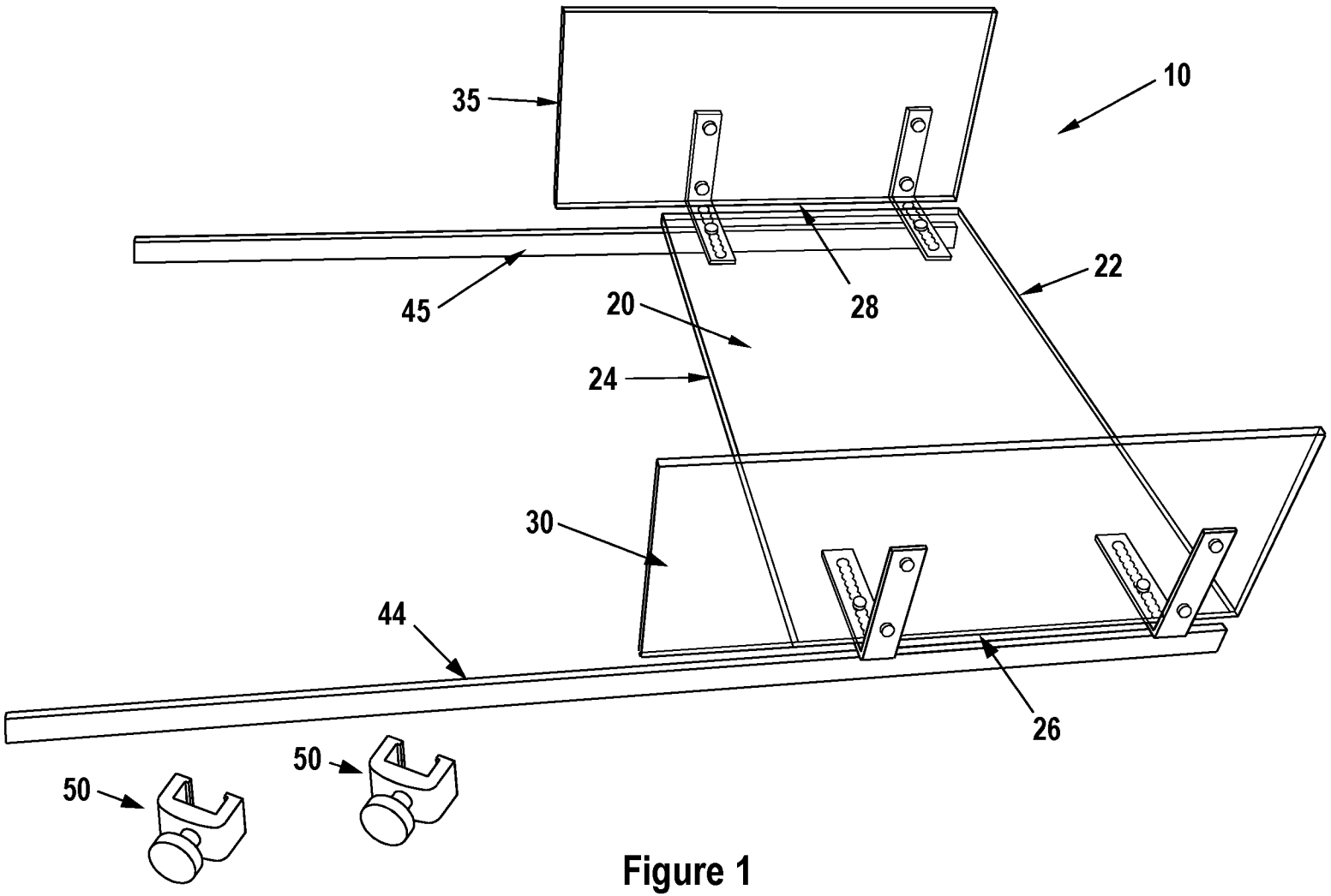
FIG. 1 illustrates structural components of one embodiment of the frame of an arm positioning device.

For the purpose of promoting an understanding of the principles of the invention, reference will now be made to embodiments, some of which are illustrated in the drawings, and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. In the discussions that follow, a number of potential features or selections of assay methods, methods of analysis, or other aspects, are disclosed. It is to be understood that each such disclosed feature or features can be combined with the generalized features discussed, to form a disclosed embodiment of the present invention.

Unless otherwise defined, all technical and scientific terms used herein have the same meaning as commonly understood by one of ordinary skill in the art to which this invention pertains. In case of conflict, the present document, including definitions, will control. Preferred methods and materials are described below, although methods and materials similar or equivalent to those described herein can be used in the practice or testing of the present invention.

The uses of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as", "for example") provided herein, is intended merely to better illuminate the invention and does not pose a limitation on the scope of the invention unless otherwise claimed. No language in the specification should be construed as indicating any non-claimed element as essential to the practice of the invention.

One embodiment of the present invention provides a positioning device for positioning the limbs of a patient placed on an operating room table. In a preferred embodiment, the device is utilized to position the arms of a patient lying supine on the table. In one embodiment, the device provides a safe, rapid and reproducible method of securing a patient's arms across the chest during a medical procedure and facilitates the use of C-arm fluoroscopy during the surgery. In a preferred embodiment, the device is utilized during an anterior lumbar interbody fusion (ALIF) procedure or in another procedure requiring similar positioning of the patient.

In one embodiment, the positioning device is a reusable device (for example, made from metal and/or plastic) that attaches to the operating room table siderails via clamps at the level of the patient's upper chest. The device may provide a cavity in which to place the patient's crossed arms, which may be padded and secured with a strap. Positioning of the arms is rapid and reproducible and allows easier access to the patient's upper extremities for management of intravenous lines, arterial lines and/or blood pressure cuffs.

Turning first to FIG. 1, there is here illustrated a view of one embodiment of the positioning device. The device 10 includes a cross-member 20 having a top edge 22, a bottom edge 24, a first side edge 26 and a second side edge 28. A first side member 30 may attach at the first side edge 26 and extend away from a first face of cross-member 20. A second side member 35 may attach at the second side edge 28 and may also extend away from the first face of cross-member 20.

A first leg 44 may attach to the first side edge 26 and may extend downwards beyond the bottom edge 24. A second leg 45 may attach to second side edge 28 and may also extend downwards beyond the bottom edge 24. The cross member 20, the first side member 30 and the second side member 35 may define a cavity sized to accommodate a patient's arms. In some embodiments, the positioning device also includes first and second clamps 50, which are sized and shaped to clamp to the first and second legs and to attach the legs to an operating room table.

In some embodiments, at least one of the first side member and the second slide member is slidably attached to the cross member to allow the distance between the side members to be adjusted in order to accommodate patients of various sizes. In other embodiments, at least one of the legs is slidably attached to the cross-member so that the distance between the legs may be varied to accommodate operating room tables of other tables of different widths.

Figure 2:
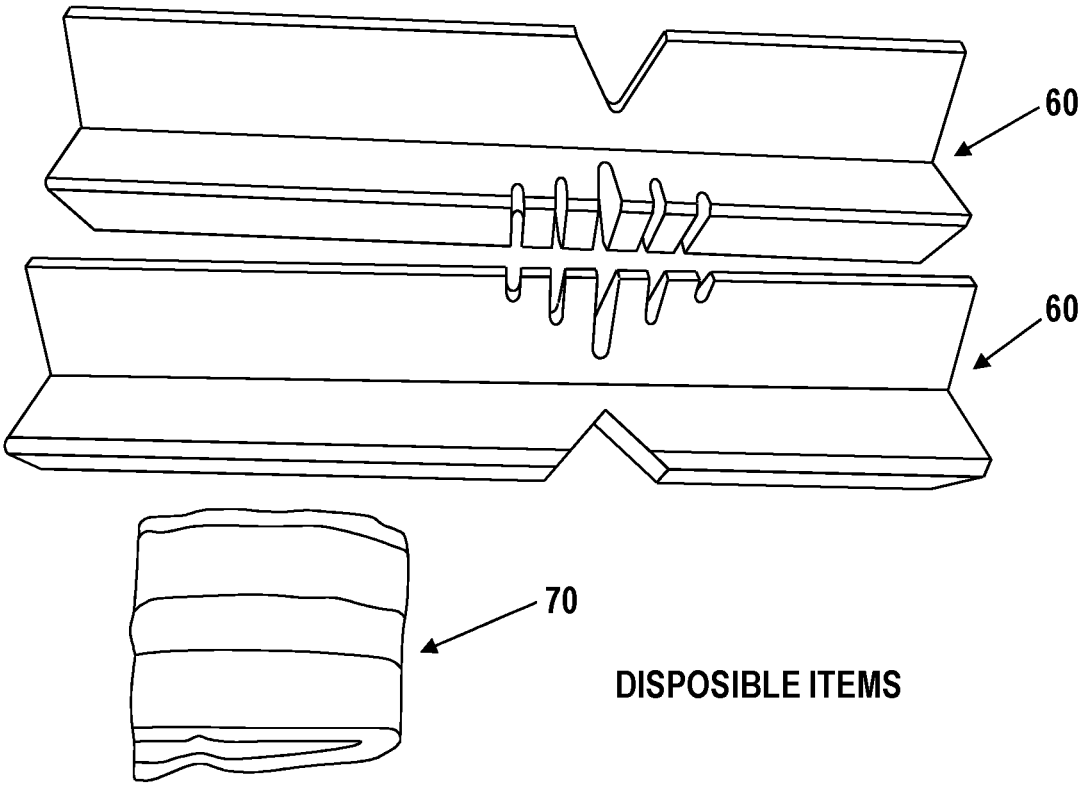
FIG. 2 illustrates one embodiment of arm cradles and a strap for use with the arm positioning device.

Turning now to FIG. 2, there are here illustrated further components that may be included in the device. At least one arm cradle 60 sized and shaped to position the arms of a patient between the first side member and the second side member may be included. In other embodiments, the positioning device includes strap 70 sized to extend around an exterior of the cross member and the first and second side members and to secure the patient's arms within the cavity. In one embodiment, the strap includes Velcro or a similar material. In another embodiment, the at least one arm cradle includes, or is formed from, a foam material.

Figure 3:
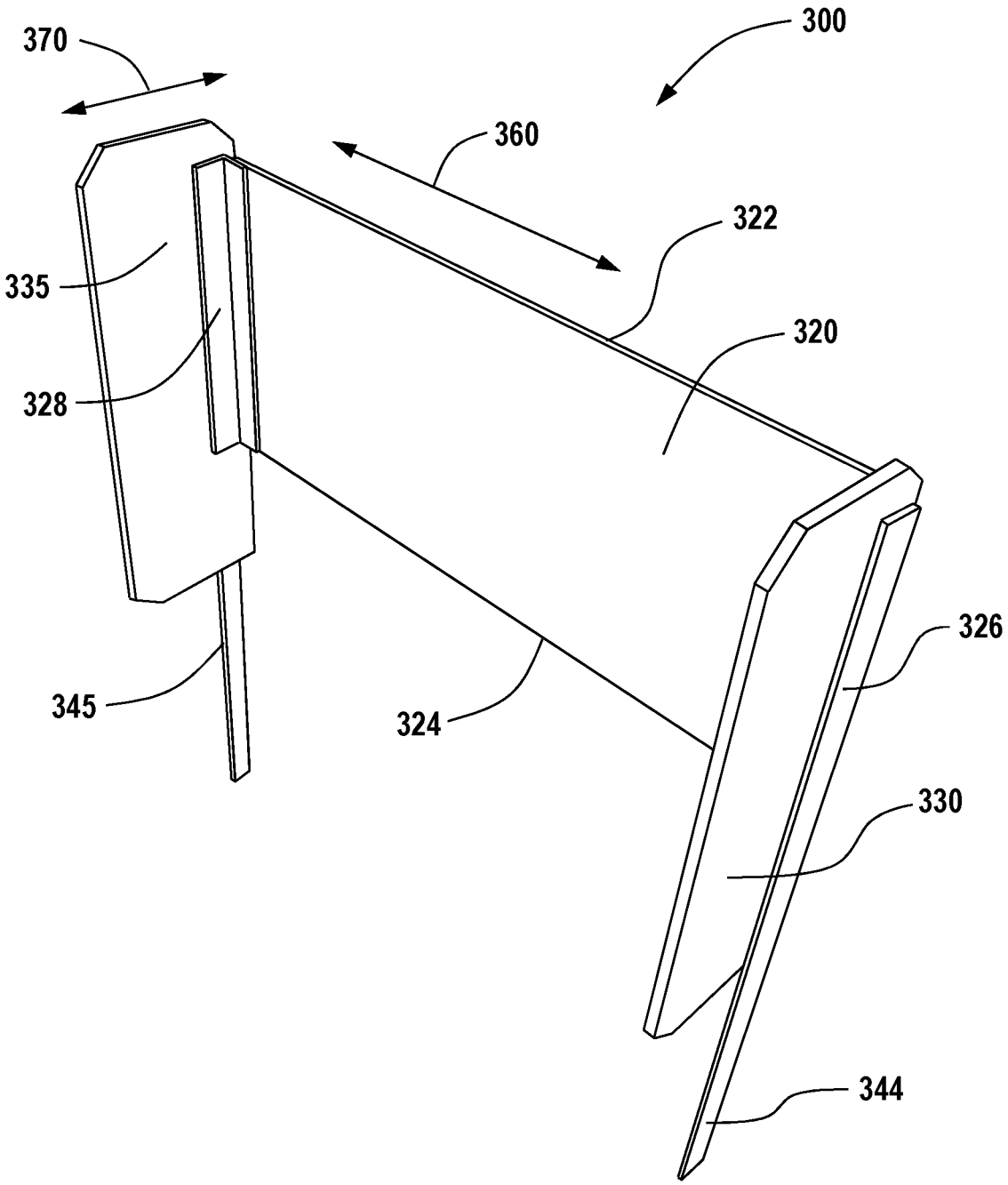
FIG. 3 illustrates structural components of another embodiment of an arm positioning device.

FIG. 3 shows another embodiment of a positioning device. The positioning device 310 may include a cross-member 320 having a top edge 322, a bottom edge 324, a first side edge 326 and a second side edge 328. The positioning device 310 may include a first side member 330 and a second side member 335.

The first side member 330 may attach at the first side edge 326 and extend away from a first face of cross-member 320. The first side member 330 may be detachable from the first side edge 326 when the positioning device is not being used, for example during storage. In one implementation, a length of the first side member 330 may be longer than that of the cross-member 320. Here, the "length" of the first side member 330 may be along a longitudinal direction of the first side edge 326.

The second side member 335 may attach at the second side edge 328 and may extend away from the first face of cross-member 20 at a same direction as the first side member 330. The second side member 335 may be detachable from the second side edge 328 when the positioning device is not being used, for example during storage. In one implementation, a length of the second side member 335 may be longer than that of the cross-member 320. Here, the "length" of the second side member 335 may be along a longitudinal direction of the second side edge 328. In another implementation, the length of the second side member 335 may equal to the length of the first side member 330.

Referring to FIG. 3, the positioning device 310 may further include a first leg 344. In one implementation, the first leg 344 may attach to the first side edge 326 and extend downwards beyond the bottom edge 24. In another implementation, the first leg 344 may extend downwards beyond the first side member 330.

The positioning device 310 may further include a second leg 345, which may attach to the second side edge 328. In one implementation, the second leg 345 may extend downwards beyond the bottom edge 324. In another implementation, the second leg 345 may extend downwards beyond the second side member 335.

The cross member 320, the first side member 330 and the second side member 335 define a cavity sized to accommodate a patient's arms. In one implementation, to accommodate variable sizes of patient's arms, the first side member 330 may be slidable along a direction 360 relative to the cross member 320. Optionally, the second side member 335 may be slidable along a direction 360 relative to the cross member 320. The direction 360 may be parallel to the first face of the cross member 320. In another implementation, to accommodate variable sizes of patient's arms, the second side member 335 may be slidable along another direction 370 relative to the cross member 320. Optionally, the first side member 330 may be slidable along a direction 370 relative to the cross member 320. The direction 370 may be perpendicular to the first face of the cross member 320.

The cross member 320, the first side member 330, and the second side member 335 may made from any material suitable to provide support, including but not limited to, metal, aluminum alloy, plastic, polycarbonate, and acrylic sheet. The material may be transparent, semi-transparent, or opaque. To improve comfort for patient, the material may be air and/or humidity permeable. In one implementation, the material may have arrays of holes, so that air and humidity may freely pass through them.

Another aspect of the present invention provides a method of positioning the arms of a patient, for example a human patient, during a surgical procedure. The surgical procedure may be, for example but not limited to, anterior lumbar interbody fusion. In one embodiment, the method includes attaching the arm positioning device as described herein to an operating room table. FIG. 4 illustrates one embodiment of the device positioned over an operating room table. FIG. 5 illustrates a patient positioned on the operating room table with the device in position to receive the patient's arms.

FIG. 6 illustrates positioning a patient's arms within the cavity of the arm positioning device in a crossed position. The at least one arm cradle, and possibly additional packaging, may be used to pad pressure points on the chest and arms of the patient. FIG. 7 illustrates positioning the at least one arm cradle and the arms of the patient. In one embodiment, the width of the cavity is adjusted to accommodate the patient. FIG. 8 illustrates the strap in position to secure the arms of the patient within the cavity. FIG. 9 shows a cranial view of the device. FIG. 10 shows a caudal view of the device.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

I claim:

1. A positioning device comprising:

a cross member having a top edge, a bottom edge, a first side edge and a second side edge;

a first side member attaching at the first side edge and extending away from a first face of the cross member;

a second side member attaching at the second side edge and extending away from the first face of the cross member;

a first leg attaching to the first side edge and extending downwards beyond the bottom edge; and a second leg attaching to the second side edge and extending downwards beyond the bottom edge, wherein the cross member, the first side member and the second side member define a cavity sized to accommodate a patient's arms, and wherein at least one of the first side member and the second side member is slidably attached to the cross member.

2. The positioning device of claim 1, further comprising first and second clamps, wherein the first and second clamps are sized and shaped to clamp to the first and second legs.

3. The positioning device of claim 1, wherein further comprising at least one arm cradle sized and shaped to position the arms of a patient between the first side member and the second side member.

4. The positioning device of claim 3, further comprising a strap sized to extend around an exterior of the cross member and the first and second side members and to secure the patient's arms within the cavity.

5. The positioning device of claim 4, therein the strap comprises Velcro.

6. The positioning device of claim 3, wherein the at least one arm cradle comprises a foam material.

7. The positioning device of claim 1, wherein at least one of the first side member and the second slide member is slidable along a direction parallel to the first face of the cross member.

8. The positioning device of claim 1, wherein at least one of the first side member and the second slide member is slidable along a direction perpendicular to the first face of the cross member.

9. A method of positioning arms of a patient during a surgical procedure comprising:

attaching an arm positioning device to an operating room table, wherein the arm positioning device comprises:

a cross member having a top edge, a bottom edge, a first side edge and a second side edge, a first side member attaching at the first side edge and extending away from a first face of the cross member, a second side member attaching at the second side edge and extending away from the first face of the cross member, a first leg attaching to the first side edge and extending downwards beyond the bottom edge, and a second leg attaching to the second side edge and extending downwards beyond the bottom edge, wherein the cross member, the first side member and the second side member define a cavity sized to accommodate a patient's arms;

positioning a patient's arms within the cavity of the arm positioning device in a crossed position;

positioning at least one arm cradle within the arms of the patient; and placing a strap around the cavity to secure the patient's arms within the cavity.

10. The method of claim 9, wherein the surgical procedure is anterior lumbar interbody fusion or other procedure requiring the arms of the patients in the crossed position.

11. The method of claim 9, wherein the patient's arms need to be positioned during the surgical procedure.

* * * * *